US012778375B1

(12) United States Patent
Chan et al.

(10) Patent No.: US 12,778,375 B1
(45) Date of Patent: Nov. 3, 2026

(54) SLEEVE HOLDER FOR A CLEANING DEVICE

(71) Applicant: Future Innovations Holding Company Corp., Orinda, CA (US)

(72) Inventors: Erik Chan, Orinda, CA (US); Alexander Chan, Alameda, CA (US)

(73) Assignee: FUTURE INNOVATIONS HOLDING COMPANY CORP., Orinda, CA (US)

( * ) Notice: Subject to any disclaimer, the term of this patent is extended or adjusted under 35 U.S.C. 154(b) by 0 days.

(21) Appl. No.: 19/433,108

(22) Filed: Dec. 26, 2025

Related U.S. Application Data

(60) Provisional application No. 63/873,290, filed on Aug. 29, 2025.

(51) Int. Cl.
*A47L 13/46* (2006.01)
*A47L 13/16* (2006.01)
*A47L 13/29* (2006.01)

(52) U.S. Cl.
CPC ..... *A47L 13/46* (2013.01); *A47L 13/16* (2013.01); *A47L 13/29* (2013.01)

(58) Field of Classification Search
CPC ..... A47L 13/46; A47L 13/16; A47L 13/29; A47L 13/44; A47L 13/258
See application file for complete search history.

(56) References Cited

U.S. PATENT DOCUMENTS

2013/0227807 A1* 9/2013 Bruno ..... A47L 13/44 15/231
2021/0038049 A1* 2/2021 Bailey ..... A47L 13/08

* cited by examiner

*Primary Examiner* — Andrew A Horton
(74) *Attorney, Agent, or Firm* — EVERGREEN VALLEY LAW GROUP; Kanika Radhakrishnan

(57) ABSTRACT

Embodiments of the present disclosure discloses a cleaning device. The cleaning device includes a sleeve and a sleeve holder. The sleeve holder is configured to receive the sleeve. The sleeve holder includes an extension-retraction element coupled into the sleeve holder. The extension-retraction element is configured to transition the sleeve holder between a retracted state and an extended state in response to an applied lateral actuation force. Further, the sleeve holder in the retracted state, the extension-retraction element selectively permits insertion and withdrawal of the sleeve onto and from the sleeve holder, respectively. Furthermore, the sleeve holder in the extended state, the extension-retraction element returns the sleeve holder upon removal of the applied lateral actuation force. The extended state of the sleeve holder facilitates a snug fit between an outer surface of the sleeve holder and an inner surface of the sleeve during use.

20 Claims, 9 Drawing Sheets

SLEEVE HOLDER FOR A CLEANING DEVICE

TECHNICAL FIELD

The present disclosure generally relates to sleeve holders, and more particularly, to a sleeve holder incorporating an extension-retraction element for easy insertion, secure engagement, and controlled removal of a sleeve to improve the operation of a device.

BACKGROUND

Cleaning devices often incorporate replaceable, disposable, or washable covering members that are designed to fit over a holding structure to enable effective cleaning of a variety of surfaces. The covering members must be securely retained on the holding structure during use to prevent unwanted slippage, rotation, or detachment, which could compromise cleaning performance and reduce user satisfaction. These covering members are typically used to scrub, absorb, or wipe away dirt, moisture, or other contaminants from surfaces, such as floors, windows, countertops, or equipment. In many cases, the effectiveness of the cleaning process depends on the material properties of the covering member, its stable and consistent contact with the cleaning surface, which requires firm yet adaptable support from the holding structure.

Conventional holding mechanisms for the holding structure commonly rely on mechanical components such as hinges, clamps, sliding elements, or spring-loaded parts to retain the removable or replaceable covering member in position. While these mechanisms can effectively provide a secure fit, they often result in increased structural complexity and involve additional manufacturing and assembly steps, ultimately leading to higher production costs. The presence of multiple moving parts introduces numerous potential points of mechanical failure, making the holding structure more susceptible to wear, fatigue, deformation, or malfunction over time. These issues are particularly critical in applications requiring frequent use, repeated part replacement, or exposure to demanding operational environments, where long-term reliability and ease of maintenance are essential.

In addition to these mechanical limitations, user interaction with such holding structures can be unfavorable. The process of attaching or removing the covering member often involves multiple steps, the use of tools, or precise alignment, which can be cumbersome and time-consuming. This creates a significant inconvenience in situations where quick replacement or frequent cleaning is necessary, such as in professional, industrial, or healthcare settings. Furthermore, bulky or rigid designs resulting from these mechanical assemblies can negatively impact the ergonomics, portability, and aesthetics of the cleaning device, ultimately diminishing the overall user experience and practicality.

Therefore, there is a need for a simpler and more reliable mechanism for the holding structure that allows easy and secure attachment and removal of covering members, overcoming the aforementioned deficiencies while providing additional technical advantages.

SUMMARY

Various embodiments of the present disclosure provide a cleaning device.

In an embodiment, a cleaning device is disclosed. The cleaning device includes a sleeve and a sleeve holder. The sleeve holder is configured to receive the sleeve. The sleeve holder includes an extension-retraction element coupled into the sleeve holder. The extension-retraction element is configured to transition the sleeve holder between a retracted state and an extended state in response to an applied lateral actuation force. Further, the sleeve holder in the retracted state, the extension-retraction element selectively permits insertion and withdrawal of the sleeve onto and from the sleeve holder, respectively. Furthermore, the sleeve holder in the extended state, the extension-retraction element returns the sleeve holder upon removal of the applied lateral actuation force. The extended state of the sleeve holder facilitates a snug fit between an outer surface of the sleeve holder and an inner surface of the sleeve during use.

In another embodiment, the present disclosure also provides the cleaning device. The cleaning device includes a sleeve and a sleeve holder. The sleeve holder is configured to receive the sleeve. The sleeve holder includes an extension-retraction element coupled into the sleeve holder. The extension-retraction element includes a body portion extending longitudinally from a first end section of a first member. The body portion is configured to interface with a housing compartment. Further, the extension-retraction element includes a trigger portion. The trigger portion is operatively coupled to the body portion longitudinally to facilitate the application of a lateral actuation force. The extension-retraction element is configured to transition the sleeve holder between a retracted state and an extended state in response to the applied lateral actuation force. Furthermore, the sleeve holder in the retracted state, the extension-retraction element selectively permits insertion and withdrawal of the sleeve onto and from the sleeve holder, respectively. The sleeve holder in the extended state, the extension-retraction element returns the sleeve holder upon removal of the applied lateral actuation force. The extended state of the sleeve holder facilitates a snug fit between an outer surface of the sleeve holder and an inner surface of the sleeve during use.

BRIEF DESCRIPTION OF THE FIGURES

The following detailed description of illustrative embodiments is better understood when read in conjunction with the appended drawings. For the purposes of illustrating the present disclosure, exemplary constructions of the disclosure are shown in the drawings. However, the present disclosure is not limited to a specific device, or a tool and instrumentalities disclosed herein. Moreover, those in the art will understand that the drawings are not to scale. Wherever possible, like elements have been indicated by identical numbers.

Figure 1A:
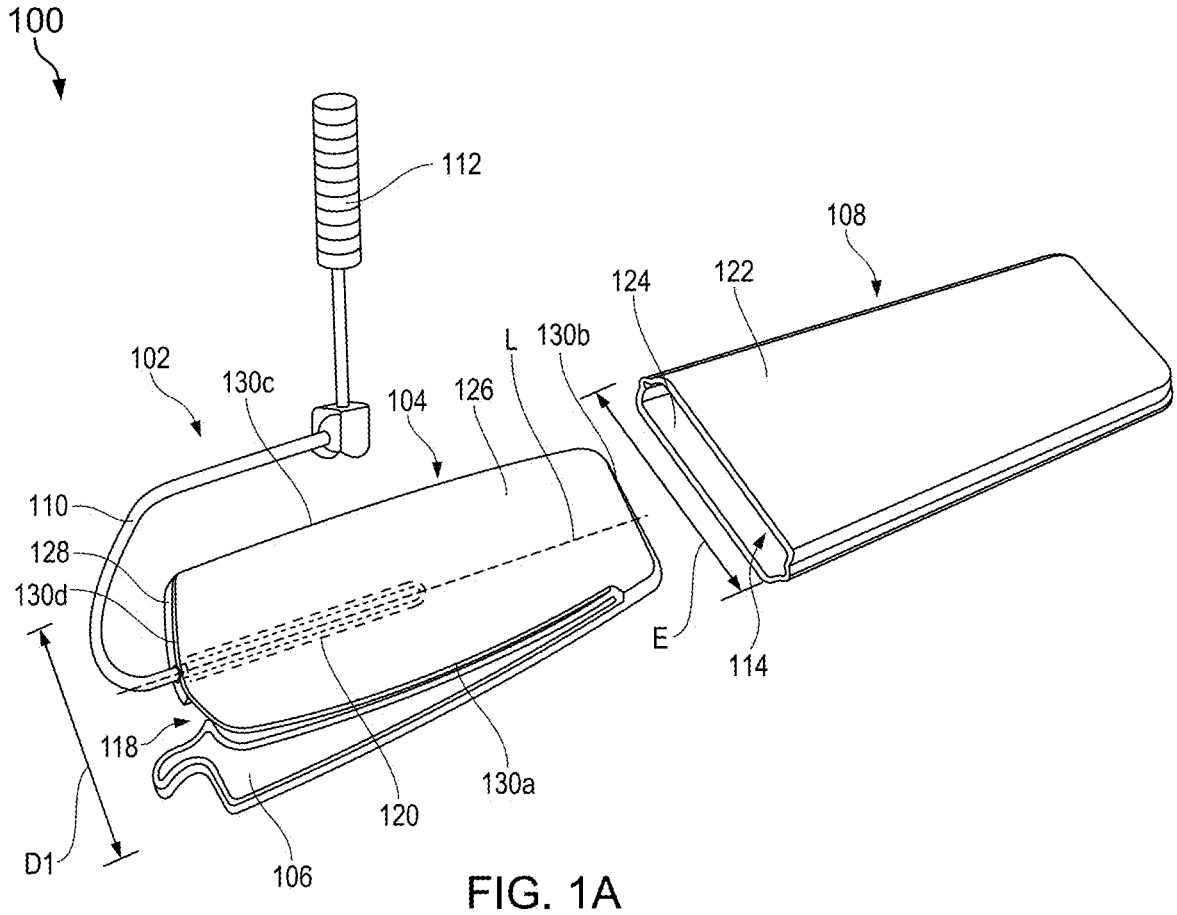
FIGS. 1A, 1B, and 1C illustrate an example environment including a cleaning device, in accordance with various embodiments of the present disclosure.

The drawings referred to in this description are not to be understood as being drawn to scale except if specifically noted, and such drawings are only exemplary in nature.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Reference in this specification to "one embodiment" or "an embodiment" means that a particular feature, structure, or characteristic described in connection with the embodiment is included in at least one embodiment of the present disclosure. The appearances of the phrase "in an embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Moreover, although the following description contains many specifics for the purposes of illustration, anyone skilled in the art will appreciate that many variations and/or alterations to said details are within the scope of the present disclosure. Similarly, although many of the features of the present disclosure are described in terms of each other, or in conjunction with each other, one skilled in the art will appreciate that many of these features can be provided independently of other features.

Overview

Various embodiments of the present disclosure provide a cleaning device. The cleaning device includes a sleeve and a sleeve holder. The sleeve holder includes an extension-retraction element that facilitates easy insertion, secure engagement, and controlled removal of a sleeve inserted onto a sleeve holder, making it suitable for various devices requiring stable sleeve attachment and release. The extension-retraction element allows the sleeve holder to transition between a retracted state and an extended state through the application and release of a lateral actuation force, utilizing the resilience and elastic properties of the material. This mechanism enables quick mounting and demounting of the sleeve while ensuring a tight, stable interface during operation. The design is compact, passive, and eliminates the need for springs or powered actuators, making it highly effective for devices that demand simplicity, reliability, and repeatable user-controlled interaction.

Without limitation, the novelty of the invention lies in the ability of the extension-retraction element to act as a self-contained return mechanism, which facilitates the user-driven movement of the sleeve holder and ensures automatic return to the extended position without requiring additional components. In the extended state, the extension-retraction element forms a secure engagement between the sleeve holder and the sleeve, while in the retracted state, it allows smooth and resistance-free insertion or removal of the sleeve. This feature significantly reduces design complexity and enhances overall mechanical performance and user convenience.

The design of the sleeve holder offers significant advantages by eliminating the need for conventional mechanical components such as hinges, sliding mechanisms, or separate actuators. This reduction in parts simplifies the overall structure, lowers manufacturing costs, and enhances reliability by minimizing potential points of mechanical failure. Additionally, the simplicity and adaptability of the mechanism make it suitable for a wide range of applications that require adjustable or variable-size holders, including but not limited to sleeve holders, bag supports, and other devices where a secure yet adjustable fit is essential.

While the extension-retraction element is adaptable for many device types, a particularly effective application is in a cleaning device including the sleeve holder, a connecting member, and a handlebar. The sleeve holder is rotatably coupled to the connecting member, and the handlebar is pivotally coupled to the connecting member to allow ergonomic handling. The sleeve holder includes a first member and an overlapping second member, with the extension-retraction element coupled into the first member. The element extends from a first end section to a second end section along the longitudinal axis of the sleeve holder, forming a lateral space-part configuration. The sleeve holder also includes a housing compartment and a retention slot that guides the movement of the extension-retraction element.

The extension-retraction element consists of a body portion and a trigger portion. The body portion interfaces with the housing compartment, while the trigger portion, which is either integrally formed with or operatively connected to the body, enables user actuation. A positioning pin operatively coupled with the trigger portion travels within the retention slot, guiding the movement of the extension-retraction element between two states. When the user applies a lateral actuation force, the positioning pin moves toward a second lateral end of the retention slot, placing the element in the retracted state. In this position, the body portion is received within the housing compartment, allowing the sleeve to be mounted or removed easily. Upon release of the force, the resilience and elastic properties of the material restore the extension-retraction element to the extended state, thereby securing the sleeve in place and preventing unintended slippage or rotation during use.

Various embodiments of the present disclosure are described hereinafter with reference to FIGS. 1A-1C to 2A-2F.

Figure 1B:
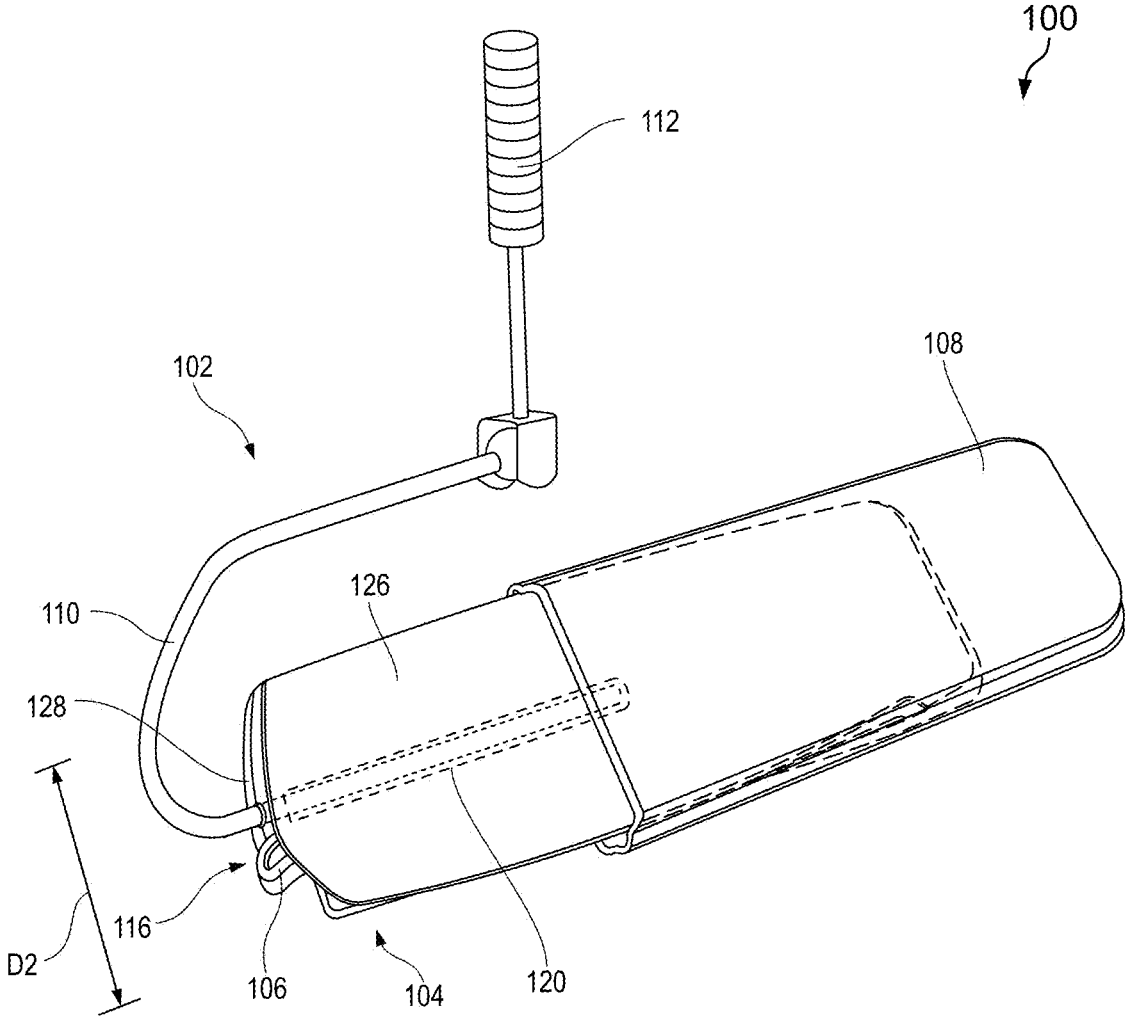
Figure 1C:
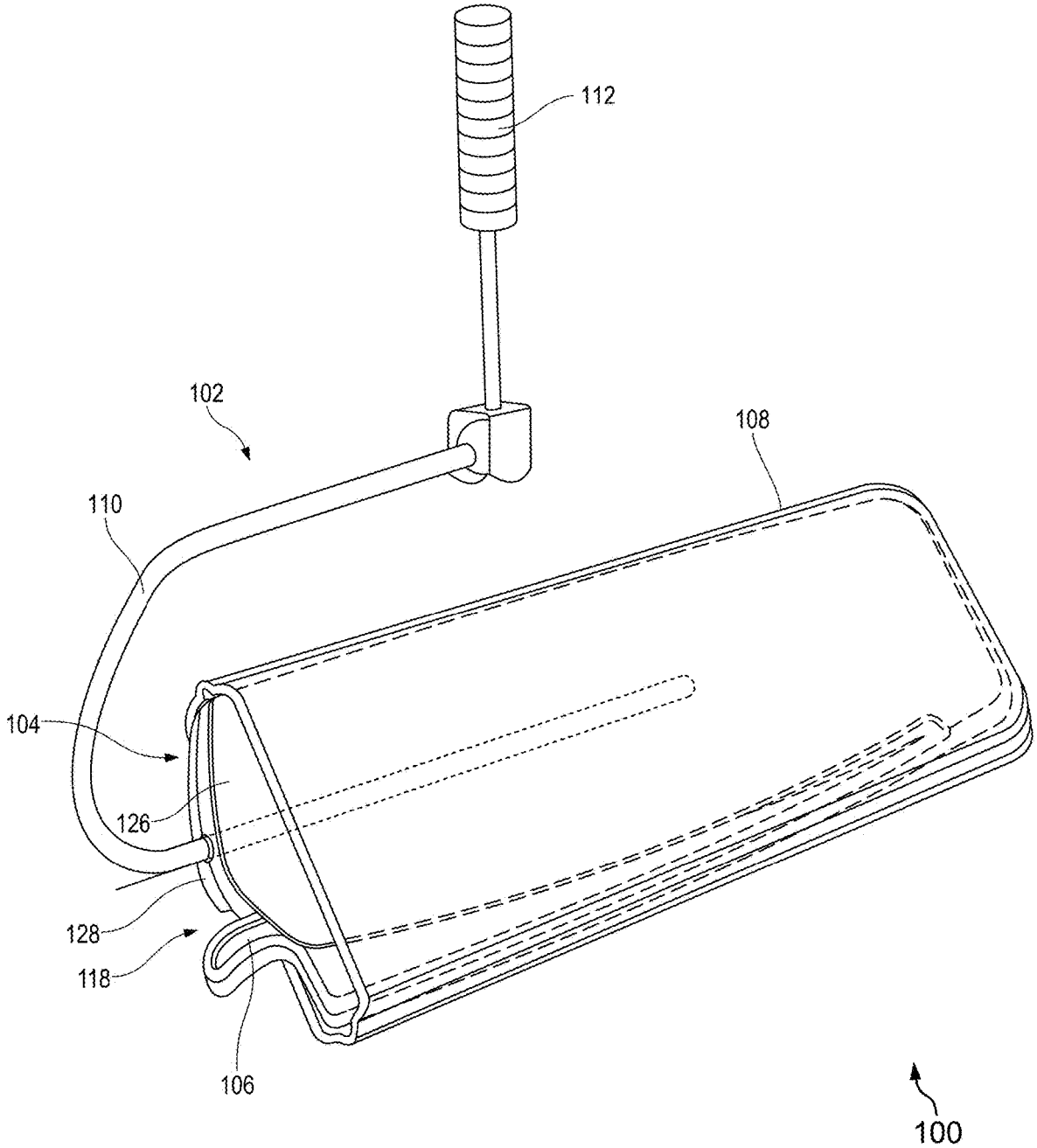

FIGS. 1A, 1B, and 1C illustrate an example environment 100, in accordance with various embodiments of the present disclosure. In the illustrated example, the environment 100 includes a device embodied as a cleaning device 102, which includes a sleeve holder 104 incorporating an extension-retraction element 106. The extension-retraction element 106 facilitates the sleeve holder 104 to be inserted into a sleeve 108, securely covered during operation, and subsequently withdrawn after performing its intended function. The sleeve 108 is configured to slide over the sleeve holder 104, forming a snug and stable interface during use.

Depending on the application, the sleeve 108 may serve a variety of purposes, including, but not limited to, cleaning, polishing, scrubbing, applying substances, or providing a protective barrier. While the illustrated embodiment pertains to the cleaning device 102, where the sleeve 108 is embodied as a cleaning pad that is applied to, retained on, and removed from the sleeve holder 104 through actuation of the extension-retraction element 106 by the user, the disclosed principles are not limited to this context. Other implementations of the environment 100 may include devices or apparatuses used in industrial, medical, consumer, or specialized applications where a customized holder, incorporating the extension-retraction element 106, is adapted to be firmly covered by a removable or disposable surface interface. Such devices may include, but are not limited to, robotic arms, surface treatment systems, personal care appliances, or any apparatus that utilizes interchangeable coverings for functional deployment.

Additionally, in some implementations, the environment 100 may include one or more devices that incorporate the extension-retraction element 106 to control the movement of a device component along a defined path, allowing for extension and retraction within a predetermined range. This controlled movement may be significant for positioning components precisely during deployment and retraction cycles. For example, such implementations may involve holders for sleeves, bags, or similar functional elements that require accurate and repeatable positioning between extended and retracted states.

As shown in FIGS. 1A-1C, the cleaning device 102 is equipped with the sleeve holder 104, a connecting member 110, and a handlebar 112. The sleeve holder 104 is rotatably coupled to the connecting member 110, and the handlebar 112 is pivotally coupled to the connecting member 110. The connecting member 110 serves as a force transmission link between the sleeve holder 104 and the handlebar 112, enabling controlled movement and facilitating user operation of the sleeve holder 104.

The pivotal coupling between the handlebar 112 and the connecting member 110 may, in various embodiments, be implemented using a range of mechanical configurations, including, but not limited to, a hinge joint, a pivot pin, or a ball-and-socket joint. The selection of the coupling mechanism may be based on considerations, such as the required range of motion, mechanical durability, and functional performance of the cleaning device 102. In a non-limiting example, the pivotal coupling may be implemented as a ball-and-socket joint that enables multi-directional articulation, allowing the handlebar 112 to tilt and/or rotate relative to the connecting member 110 in multiple directions during operation of the cleaning device 102. This arrangement enhances maneuverability, ergonomic control, and user comfort, especially during prolonged use or when cleaning surfaces with complex or varying geometries.

The sleeve holder 104 is configured to be inserted into the sleeve 108, which, in this embodiment, serves as the cleaning pad, such that the sleeve 108 securely envelops the sleeve holder 104 during operation. The sleeve 108 features an insertion opening 114 (shown in FIG. 1A) specifically designed to receive the sleeve holder 104. The sleeve holder 104 incorporates the extension-retraction element 106, which allows the user to manually adjust the sleeve holder 104 between a retracted state 116 (shown in FIG. 1B) and an extended state 118 (shown in FIGS. 1A and 1C) through application of an external force, such as a lateral actuation force F (shown in FIGS. 2B and 2C).

In the retracted state 116, the sleeve holder 104 can be easily inserted into or removed from the sleeve 108 through the insertion opening 114, enabling quick and convenient replacement or removal of the sleeve 108 by the user. After the sleeve 108 is positioned over the sleeve holder 104, as shown in FIG. 1C, the extension-retraction element 106 permits the sleeve holder 104 to move into the extended state 118, creating a firm and stable engagement between the sleeve 108 and the sleeve holder 104. The sleeve holder 104, in the extended state 118, prevents slippage or accidental detachment of the sleeve 108 during cleaning operations, ensuring consistent performance. Furthermore, the design promotes user convenience by facilitating effortless changes in the sleeve 108, thereby supporting improved hygiene standards and reducing downtime between cleaning cycles.

In the extended state 118, the sleeve holder 104 extends laterally to a first lateral dimension D1 (shown in FIG. 1A), which substantially matches an internal lateral dimension E (shown in FIG. 1A) of the sleeve 108. This dimensional match creates a snugfit between an outer surface of the sleeve holder 104 and an inner surface of the sleeve 108. As a result, the sleeve 108 is securely held in place, preventing any unintended slippage, rotation, or detachment during operation of the cleaning device 102, thereby preserving both structural integrity and functional performance.

Conversely, in the retracted state 116, the sleeve holder 104 contracts to a second lateral dimension D2 (shown in FIG. 1B), which is smaller than the internal lateral dimension E of the sleeve 108. This dimensional difference introduces a lateral clearance, allowing the sleeve 108 to be easily inserted onto or removed from the sleeve holder 104 with minimal friction or resistance. It is important to note that the transition between the retracted state 116 and the extended state 118 may be accomplished manually by the user through direct application of force on the extension-retraction element 106, without the need for any integrated mechanical actuators, springs, or electronic components. The design relies on the repositioning of the extension-retraction element 106 within the sleeve holder 104 through manual actuation. This mechanically simplified configuration reduces manufacturing complexity, cost, and the likelihood of failure, while improving robustness and reliability in practical use conditions.

The sleeve holder 104 defines a channel 206*a*, 206*b* (shown in FIGS. 2A, 2C-2F) therein to accommodate an insertable portion 120 of the connecting member 110. The insertable portion 120 allows the sleeve holder 104 to be rotatably coupled to the connecting member 110 along a longitudinal axis L (shown in FIG. 1A) thereof, enabling rotational movement without requiring detachment, especially during non-operational states when no cleaning force is applied.

In a non-limiting embodiment, the insertable portion 120 enables the sleeve holder 104 to rotate a full 360 degrees about the longitudinal axis L. This rotational capability allows for smooth angular adjustments and unrestricted rotation of both the sleeve holder 104 and, consequently, the sleeve 108, as needed. By allowing the user to rotate the sleeve 108 without detaching or repositioning the cleaning device 102, this feature enhances the overall versatility and ease of use of sleeve 108. As a result, different sides of the sleeve 108, such as a first side 122 and a second side 124 (shown in FIG. 1A), can be selectively brought into contact with the cleaning surface without interrupting the cleaning process. This functionality greatly improves ergonomic handling and operational efficiency, particularly in scenarios that require repeated or multidirectional cleaning strokes.

Based on the structural design and geometry of the sleeve holder 104, the sleeve 108 can be configured with two or more functional sides, each designed to serve a specific cleaning purpose. The two or more functional sides of the sleeve 108 may feature varying textures, materials, or surface treatments tailored for actions, such as scrubbing, polishing, or wiping. The overall form and dimensions of the sleeve 108 are typically engineered to match the contours of the sleeve holder 104, ensuring a secure and stable fit throughout operation.

In the representative embodiment, the sleeve holder 104 is designed with two functional sides, enabling dual-sided cleaning capability of the sleeve 108. The sleeve holder 104 includes a first member 126 and a second member 128. The first member 126 is configured to overlap the second member 128, forming a partially enclosed structure. In some embodiments, the sleeve holder 104 may further include one or more intermediate members positioned between the first member 126 and the second member 128. The one or more intermediate members may serve a variety of functional roles, such as but not limited to, providing structural reinforcement, facilitating alignment and spacing, or incorporating additional features such as guides, channels, absorbent surfaces, cleaning elements, or actuation mechanisms that enhance the effectiveness and reliability of the cleaning process.

In the representative embodiment, a first peripheral side 130*a* of the sleeve holder 104 remains at least partially open, serving as an accessible interface with the extension-retraction element 106. This opening facilitates the transition between the extended state 118, where the sleeve 108 is securely held in place during cleaning, and the retracted state 116, where the sleeve 108 can be easily inserted, removed, or replaced for cleaning by the user. The other peripheral sides, including a second side 130*b*, a third side 130*c*, and a fourth side 130*d*, are enclosed, sealed, or permanently joined to provide structural rigidity and ensure secure retention of the sleeve 108 during operation. Further details regarding the operational characteristics and structural behavior of the sleeve holder 104 in the retracted state 116 and the extended state 118 are provided with reference to FIGS. 2A through 2F.

In the representative embodiment, the sleeve holder 104 features a substantially trapezoidal shape, specifically designed to match the internal contour of the sleeve 108, which shares the same geometric form. This shape compatibility ensures a snug and stable fit between the sleeve 108 and the sleeve holder 104, effectively minimizing the potential for slippage or unintentional detachment during use. The substantially trapezoidal shape enhances structural stability while optimizing surface area contact for improved cleaning efficiency. Additionally, the substantially trapezoidal shape preserves the maneuverability of the cleaning device 102, making it particularly effective for reaching confined or angular spaces such as corners, edges, or baseboards.

It should be understood that the substantially trapezoidal shape of the sleeve holder 104, and consequently the sleeve 108, is presented by way of example only and is not intended to limit the design. The geometry of the sleeve holder 104, and consequently the sleeve 108, can be modified in alternative embodiments to suit specific functional or ergonomic requirements. For example, the sleeve holder 104, and consequently the sleeve 108, may be designed in rectangular, square, circular, elliptical, oval, or irregular polygonal shapes. These alternative shapes may be selected based on a variety of considerations, including, but not limited to, the nature of the surface being cleaned (e.g., hardwood, tile, textured flooring), the size and shape of the area (e.g., residential rooms, industrial corners), user handling preferences, storage requirements, and aesthetic choices. Additionally, the internal structure of the sleeve 108 and the external structure of the sleeve holder 104 may include shape-enhancing or retaining elements, such as ribs, guide grooves, or compression zones, that assist in maintaining the intended geometry during operation and over repeated use.

During operation, the user typically applies controlled manual force to the handlebar 112, either by pushing the cleaning device 102 away from the user's body or pulling it back toward the user's body. These opposing motions are often performed in an alternating sequence during standard cleaning strokes. Additionally, the handlebar 112 may be ergonomically designed to provide the user with a secure and comfortable grip. The shape, contour, and material of the handlebar 112 are selected to minimize user fatigue and enhance control during use, accommodating a variety of hand sizes and grip preferences. To support various uses and reduce fatigue during extended cleaning, the handlebar 112 is optimized in shape, size, and material. The handlebar 112 may be contoured to fit the natural hand shape, include non-slip textures, or have padding for added comfort. In some cases, the handlebar 112 is angled or curved to encourage a natural wrist position, helping to minimize strain during repetitive use.

In some embodiments, the handlebar 112 is angled or curved to promote a natural wrist posture, thereby reducing strain during repetitive use. Additionally, the handlebar 112 may be designed to support multiple usage positions. For example, the user can hold the handlebar 112 by hand or brace it against the leg, knee, or other parts of the body to gain added leverage and stability, which is particularly helpful when applying downward pressure or cleaning hard-to-reach areas. In alternate embodiments, the handlebar 112 may be extendable or collapsible, allowing the user to adjust the length to suit the user's height or the type of surface being cleaned (e.g., floor vs. ceiling tiles). In some cases, articulating joints or swivel features may be integrated to improve maneuverability or access into tight spaces.

The connecting member 110, which is configured as a rigid structural member, transmits the controlled manual force from the handlebar 112 to the sleeve holder 104, which holds the sleeve 108. The connecting member 110 is designed to endure repeated mechanical stresses, including compressive and bending stresses, while maintaining proper alignment and consistent force transfer between the handlebar 112 and the sleeve holder 104. This reliable transmission of the controlled manual force ensures that the sleeve holder 104 remains in firm contact with the cleaning surface, such as floors, walls, or glass, enabling the necessary rubbing action to effectively remove dirt, grime, or liquid residues.

Figure 2A:
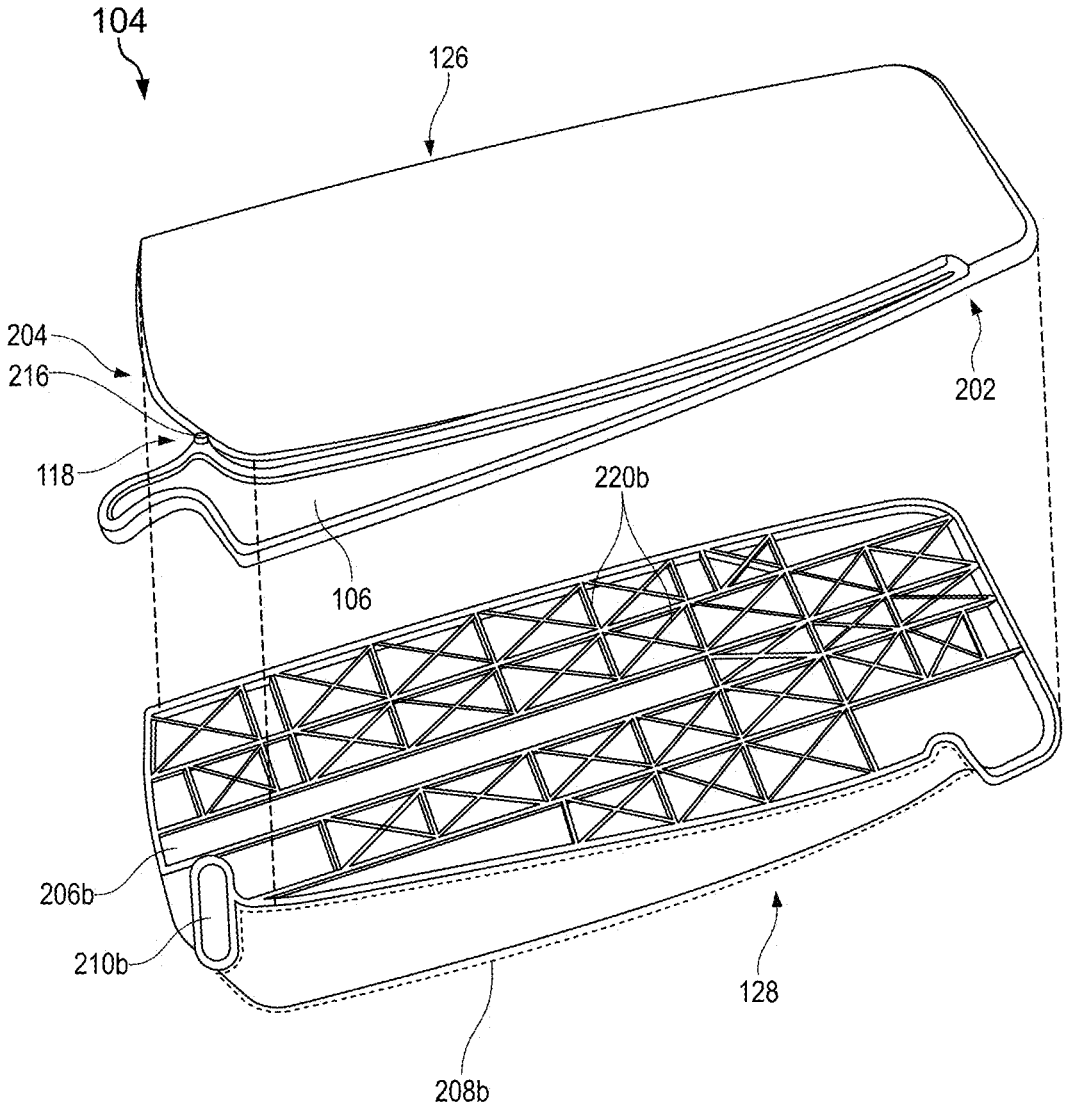
FIG. 2A illustrates an exploded view of a sleeve holder of the cleaning device, in accordance with an embodiment of the present disclosure.
Figure 2B:
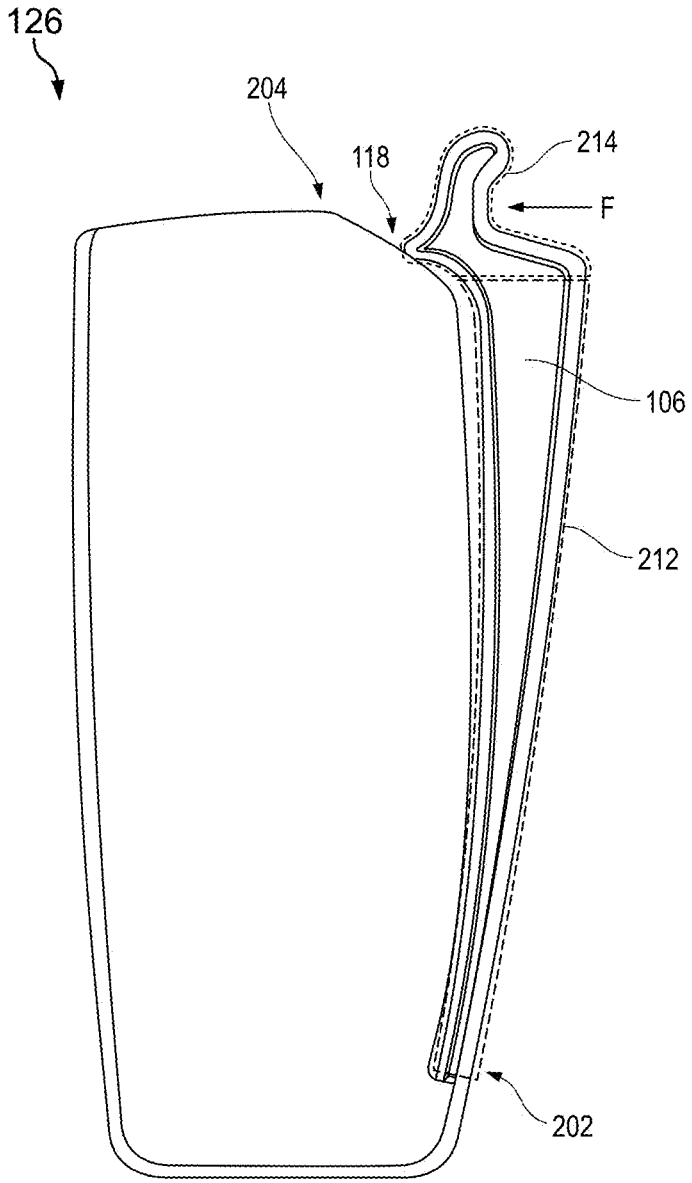
FIG. 2B illustrates a top view of a first member of the sleeve holder in an extended state, in accordance with an embodiment of the present disclosure.
Figure 2C:
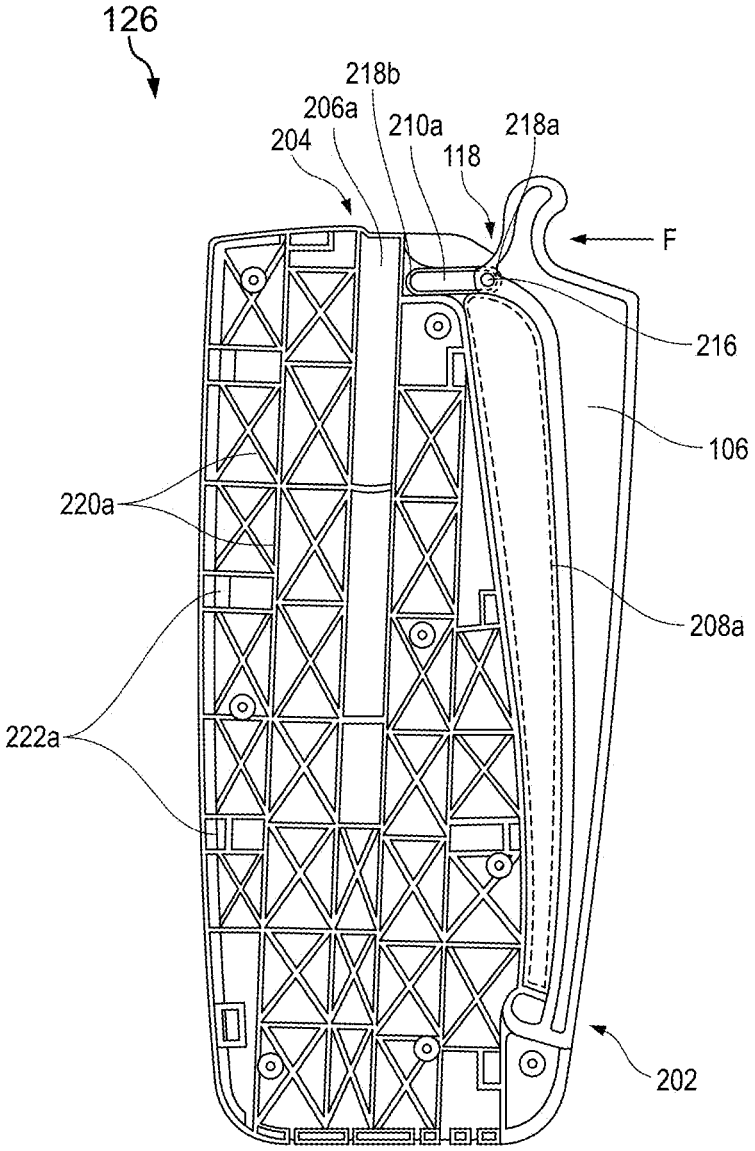
FIG. 2C illustrates a bottom view of the first member of the sleeve holder in the extended state, in accordance with an embodiment of the present disclosure.
Figure 2D:
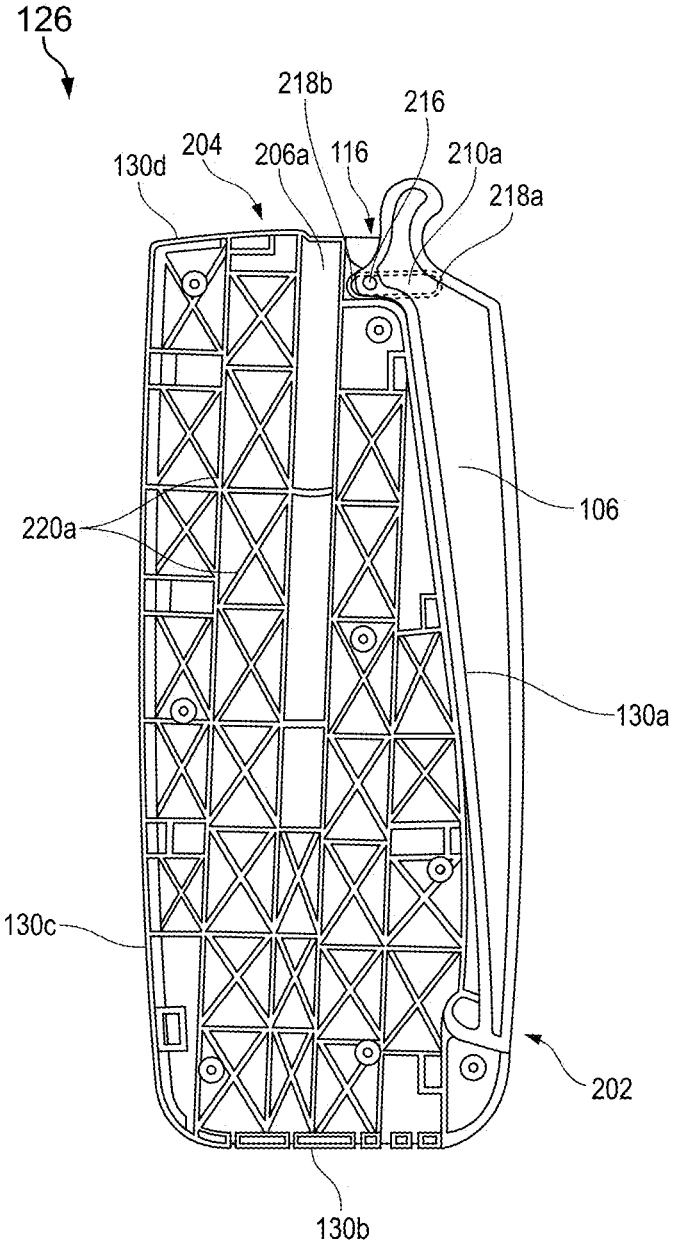
FIG. 2D illustrates a bottom view of the first member of the sleeve holder in a retracted state, in accordance with an embodiment of the present disclosure.
Figure 2E:
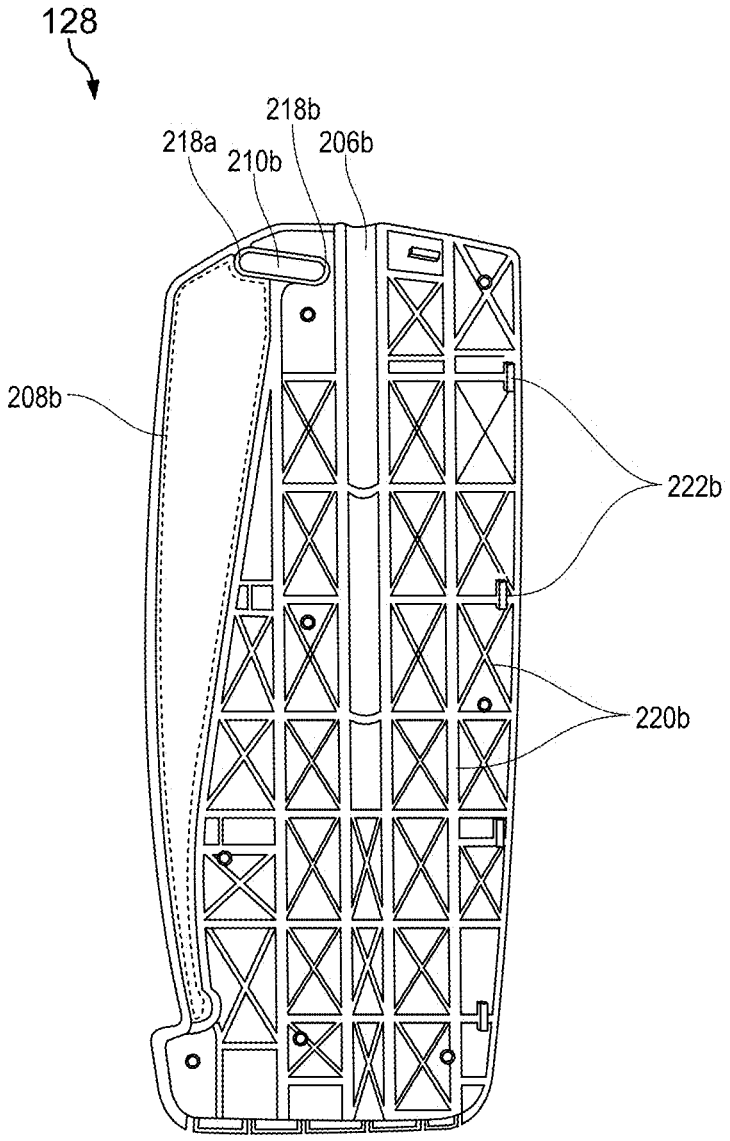
FIG. 2E illustrates a top view of a second member of the sleeve holder, in accordance with an embodiment of the present disclosure.
Figure 2F:
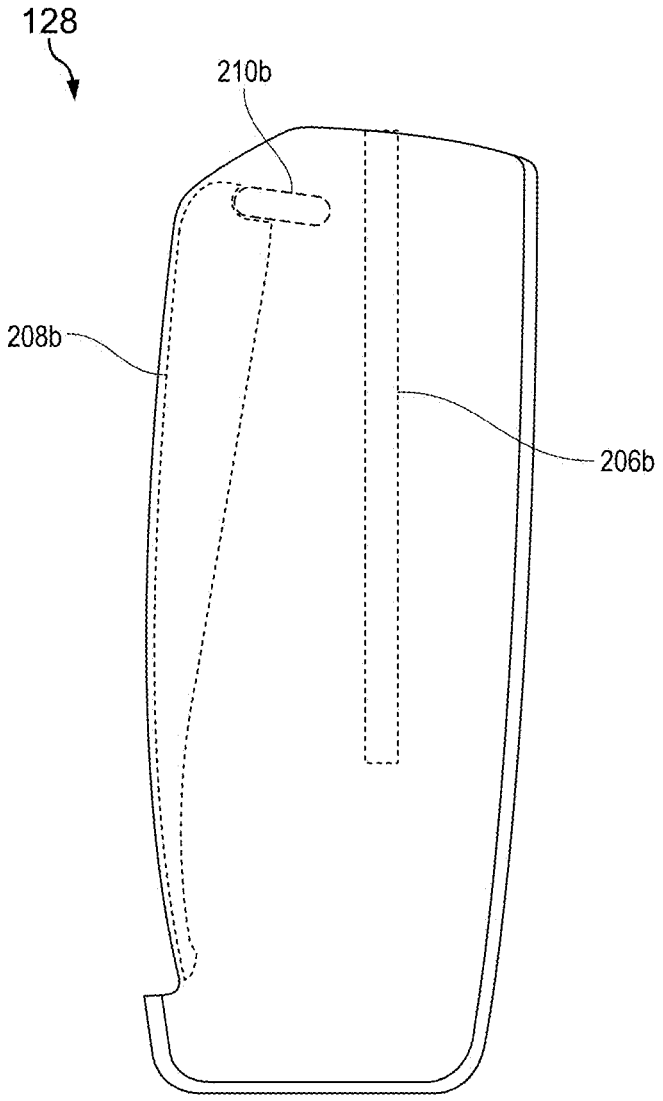
FIG. 2F illustrates a bottom view of the second member of the sleeve holder, in accordance with an embodiment of the present disclosure.

FIG. 2A illustrates an exploded view of the sleeve holder 104, in accordance with an embodiment of the present disclosure. FIG. 2B illustrates a top view of the first member 126 of the sleeve holder 104 in the extended state 118, in accordance with an embodiment of the present disclosure. FIG. 2C illustrates a bottom view of the first member 126 of the sleeve holder 104 in the extended state 118, in accordance with an embodiment of the present disclosure. FIG. 2D illustrates a bottom view of the first member 126 of the sleeve holder 104 in the retracted state 116, in accordance with an embodiment of the present disclosure. Further, FIG. 2E illustrates a top view of the second member 128 of the sleeve holder 104, in accordance with an embodiment of the present disclosure. FIG. 2F illustrates a bottom view of the second member 128 of the sleeve holder 104, in accordance with an embodiment of the present disclosure.

Referring to FIG. 2A, the first member 126 is configured to define a shape that is complementary to the shape of the second member 128. In this configuration, the first member 126 and the second member 128 are structured to overlap with one another, thereby forming an integrated assembly. The overlapping arrangement enhances the structural stability and alignment of the sleeve holder 104 during operation.

In an embodiment, the extension-retraction element 106 is coupled with the first member 126 of the sleeve holder 104. Specifically, the extension-retraction element 106 extends from a first end section 202 of the first member 126 along the longitudinal axis L of the sleeve holder 104 and continues to extend toward a second end section 204 of the first member 126, forming a lateral space-part configuration. Without deviating from the scope of disclosure, in other embodiments, the extension-retraction element 106 may be coupled with the second member 128 of the sleeve holder.

In the representative embodiment, the first member 126 and the extension-retraction element 106 are constructed as a single-piece unit, providing structural simplicity and improved mechanical integrity. However, without departing from the scope of this disclosure, alternative embodiments may implement the first member 126 and the extension-retraction element 106 as separate components. In such cases, they may be joined using suitable techniques, such as mechanical fastening, adhesive bonding, or thermal welding, ensuring reliable operation of the extension-retraction element 106 without compromising its structural or functional performance. This modular approach may offer benefits such as easier manufacturing, part replacement, or material customization based on specific application requirements. However, in each of the embodiments, the extension-retraction element 106 is designed to transition between the retracted state 116 and the extended state 118 by leveraging its inherent elastic properties and material characteristics. The change in position from the retracted state 116 to the extended state 118 occurs without the need for external actuators, relying instead on the resilience, flexibility, and shape-memory behavior of the material used in the extension-retraction element 106. This allows for a simplified design with fewer mechanical components, enhancing durability and reliability.

In order to satisfy the functionality of the extension-retraction element 106, the first member 126 is provided with a first channel 206*a*, a first housing compartment 208*a*, and a first retention slot 210*a*, as depicted in FIGS. 2C and 2D. Correspondingly, the second member 128 is provided with a second channel 206*b*, a second housing compartment 208*b*, and a second retention slot 210*b*, as depicted in FIGS. 2E and 2F. The second channel 206*b*, the second housing compartment 208*b*, and the second retention slot 210*b* are dimensioned and positioned to align and correspond with the first channel 206*a*, the first housing compartment 208*a*, and the first retention slot 210*a* of the first member 126.

Referring to FIGS. 2C and 2D in conjunction with FIGS. 2E and 2F, when the first member 126 and the second member 128 are positioned in an overlapping configuration, the first channel 206*a* and the second channel 206*b* collectively form a channel 206*a*, 206*b*. The channel 206*a*, 206*b* is configured to receive the insertable portion 120 of the connecting member 110, thereby enabling rotational coupling along the longitudinal axis L. Further, the first housing compartment 208*a* and the second housing compartment 208*b* collectively form a housing compartment 208*a*, 208*b*. The housing compartment 208*a*, 208*b* is configured to accommodate at least a portion of the extension-retraction element 106 in the retracted state 116. Furthermore, the first retention slot 210*a* and the second retention slot 210*b* collectively form a retention slot 210*a*, 210*b*, which serves to constrain and guide the movement of the extension-retraction element 106 between the retracted state 116 and the extended state 118. The retention slot 210*a*, 210*b* is operable to prevent unintended displacement of the extension-retraction element 106, thereby ensuring reliable functional performance during repeated cycles of extension and retraction.

In a specific embodiment, the extension-retraction element 106 includes a body portion 212 and a trigger portion 214. The body portion 212 extends longitudinally from the first end section 202 of the first member 126 and is configured to interface with the housing compartment 208*a*, 208*b* formed by the cooperative structure of the first housing compartment 208*a* and the second housing compartment 208*b*. The trigger portion 214 is integrally formed with or operatively connected to the body portion 212 and extends longitudinally therefrom to facilitate user interaction.

The body portion 212 is shaped and dimensioned to correspond to the geometry of the housing compartment 208*a*, 208*b*, thereby enabling a close fit that permits guided sliding or insertional movement. In the retracted state 116, the body portion 212 is housed within the housing compartment 208*a*, 208*b*, specifically from the direction of the first peripheral side 130*a*. This positioning is achieved through the application of the lateral actuation force F applied by the user to the trigger portion 214.

Upon application of the lateral actuation force F, the trigger portion 214 translates the force into movement of the body portion 212 along a predefined path within the housing compartment 208. This configuration allows the extension-retraction element 106 to transition smoothly between the retracted state 116 and the extended state 118, while maintaining proper alignment and stability. The trigger portion 214 may optionally include ergonomic or texture features to enhance grip and improve user control during operation.

To prevent unintentional displacement of the extension-retraction element 106 and to enable automatic return from the retracted state 116 to the extended state 118 upon release of the applied lateral actuation force F, the trigger portion 214 is operatively coupled with a positioning pin 216. The positioning pin 216 is configured to travel within a defined retention slot 210, which governs the movement path of the extension-retraction element 106 between the retracted state 116 and the extended state 118.

Referring to FIGS. 2B and 2C, in the absence of user input (i.e., when no lateral actuation force F is applied to the trigger portion 214), the positioning pin 216 rests at a first lateral end 218*a* of the retention slot 210, corresponding to the extended state 118. In this position, the body portion 212 of the extension-retraction element 106 is displaced outward from the housing compartment 208 relative to the first end section 202, causing the sleeve holder 104 to expand to the first lateral dimension D1. The first lateral dimension D1 is substantially equal to the internal lateral dimension E of the sleeve 108, thereby creating an interference or snug fit between the outer surface of the sleeve holder 104 and the inner surface of the sleeve 108. This tight engagement prevents unintended slippage or rotation of the sleeve 108 during cleaning operations.

Conversely, referring to FIGS. 2E and 2F, when the user applies the lateral actuation force F to the trigger portion 214, the positioning pin 216 is displaced toward a second lateral end 218*b* of the retention slot 210, which corresponds to the retracted state 116. In this state, the body portion 212 is received within the housing compartment 208, causing the sleeve holder 104 to contract to the second lateral dimension D2. The second lateral dimension D2 is less than the internal lateral dimension E of the sleeve 108, resulting in a lateral clearance that allows the sleeve 108 to be easily inserted onto or removed from the sleeve holder 104 with minimal resistance. Once the sleeve 108 is fully positioned on the sleeve holder 104, the user may release the trigger portion 214, allowing the extension-retraction element 106 to return automatically to the extended state 118 due to the resilience and the elastic properties of the material, thereby reestablishing the snug fit.

Accordingly, the effective lateral displacement between the extended state 118 and the retracted state 116, defined by the travel of the positioning pin 216 within the retention slot 210, is equal to the dimensional difference between the first lateral dimension D1 and the second lateral dimension D2 (i.e., D1-D2). This controlled travel distance ensures precise actuation of the extension-retraction element 106 and consistent engagement of the sleeve 108 with the sleeve holder 104.

By way of non-limiting example, in the extended state 118, an average clearance, such as approximately 3 to 4 millimeters, may be maintained between the first member 126 and the extension-retraction element 106. This clearance is determined, at least in part, based on the first lateral dimension D1 of the sleeve holder 104 and the internal lateral dimension E of the sleeve 108. The specified clearance facilitates proper mechanical function by allowing a smooth and controlled transition between the extended state 118 and the retracted state 116, while also ensuring that the extension-retraction element 106 remains securely positioned and properly aligned within the housing structure during operation.

To fulfill its functional requirements, the extension-retraction element 106 is fabricated from materials that possess semi-flexible or elastic properties. These characteristics enable the extension-retraction element 106 to operate efficiently as a passive return mechanism, allowing for reliable and smooth transitions between the extended state 118 and the retracted state 116. The inherent elasticity of the selected material permits the extension-retraction element 106 to deflect into the retracted state 116 in response to an applied lateral actuation force F. Once the lateral actuation force F is removed, the stored elastic energy within the material facilitates the automatic restoration of the element to its original extended state 118.

This dynamic behavior ensures precise and repeatable movement of the extension-retraction element 106 within the retention slot 210*a*, 210*b*, between the first end 218*a* and the second end 218*b*, in a direction relative to the first end section 202 of the sleeve holder 104. The use of such resilient materials eliminates the need for complex mechanical return components, reduces part count, and contributes to a more compact and maintenance-free design. Moreover, depending on the application, materials with tailored elastic modulus or shape-memory properties may be selected to optimize performance under varying operational conditions.

Suitable materials for fabricating the extension-retraction element 106 include, but are not limited to, semi-rigid thermoplastics, such as polypropylene (PP), polyethylene (PE), acrylonitrile butadiene styrene (ABS), or other polymeric materials that combine structural strength with inherent flexibility. These materials can be efficiently processed using injection molding techniques to achieve precise geometries, integrated elastic properties, and consistent performance. Without loss of generality, in some embodiments, the extension-retraction element 106 may alternatively be formed from elastomeric composites or engineered woods exhibiting semi-elastic behavior, depending on the functional requirements and target application.

It is further contemplated that the first member 126 and the second member 128 may be fabricated from the same material as the extension-retraction element 106 or from different materials altogether, depending on structural, ergonomic, or cost considerations. The selection of materials directly informs the appropriate manufacturing methodology, such as over molding, insert molding, or multi-shot injection molding, allowing designers to balance performance, durability, and production efficiency.

Those skilled in the art will recognize that the positional coupling of the extension-retraction element 106 with respect to the first member 126, or, in certain embodiments, to the second member 128, may vary depending on specific design considerations. Additionally, the geometric configuration of the extension-retraction element 106, including the shape, size, and orientation of the body portion 212 and the trigger portion 214, may be modified in alternative embodiments. Such variations may be implemented to address differing ergonomic requirements, spatial constraints, material selections, actuation preferences, or manufacturing techniques. For example, in compact applications, the trigger portion 214 may be repositioned or reduced in size to minimize user effort or accommodate limited access. Similarly, the body portion 212 may be contoured or angled to align with non-linear housing geometries or to provide enhanced mechanical leverage. These and other configuration changes may be adopted without departing from the fundamental inventive concept described herein. The core functionality, i.e., facilitating the controlled transition between the retracted state 116 and the extended state 118 to enable secure engagement or disengagement of the sleeve 108, remains consistent across such variations.

In the representative example, the first member 126 is provided with a first set of ribs 220*a*, while the second member 128 is equipped with a corresponding second set of ribs 220*b* on their respective mating surfaces. The first set of ribs 220*a* and the second set of ribs 220*b* serve multiple purposes, including enhancing the overall structural integrity of the sleeve holder 104, improving alignment and engagement between the two members (i.e., the first member 126 and the second member 128), and facilitating uniform load distribution during operation. From a manufacturing standpoint, the ribbed design also improves part stability, reduces material usage, and minimizes warping or distortion during molding or assembly processes of the sleeve holder 104.

In an embodiment, the first member 126 is positioned to overlap the second member 128 and is mechanically joined using a snap-fit mechanism. By way of representative example, the second member 128 is provided with one or more outwardly extending projections 222*b*, while the first member 126 includes one or more receiving features 222*a*, such as slots or detents, configured to engage the one or more outwardly extending projections 222*b*. Upon assembly, the one or more outwardly extending projections 222*b* on the second member 128 are inserted into the one or more receiving features 222*a* of the first member 126, resulting in secure engagement. This snap-fit connection provides a quick, tool-free, and reliable method for joining the two components, ensuring mechanical stability while allowing for potential disassembly if needed. The snap-fit also contributes to ease of manufacturing, alignment accuracy, and structural cohesion of the assembled sleeve holder 104.

However, it should be noted that the present disclosure is not limited to snap-fit joining techniques. Alternative fastening or joining methods, such as ultrasonic welding, adhesive bonding, heat staking, threaded fasteners, or mechanical clips, may also be employed, depending on the material selection, load requirements, or design preferences of the specific application.

Depending on design and manufacturing requirements, the sleeve 108 may be implemented as a single-piece, two-piece structure, or multi-piece pad. The sleeve 108 of the representative example is implemented as a two-piece cleaning pad. In the case of the two-piece cleaning pad, the first side 122 and the second side 124 are joined together using conventional methods such as stitching, adhesive bonding, ultrasonic welding, or heat sealing. The sleeve 108, which is configured as the cleaning pad in the representative example, may also include multiple layers, each tailored for a specific function, such as an outer layer for debris collection, a middle absorbent layer for holding moisture, and an inner structural layer for strength and durability. In some cases, surface textures such as ridges, loops, or bristles may be coupled into the fabric structure to improve scrubbing action and cleaning efficiency.

Depending on the intended use, in some embodiments, the sleeve 108 may be reusable or disposable. Reusable variants of the sleeve 108 are designed to withstand multiple wash cycles without significant degradation in performance, while disposable pads offer convenience for single-use cleaning tasks where hygiene or contamination control is a priority.

In some embodiments, the sleeve 108 is formed from a fabric material or a combination of materials selected to effectively capture and retain dust, dirt, moisture, and other particulates during cleaning operations. Suitable materials may include, but are not limited to, microfiber, cotton, polyester, nylon, nonwoven fabric, or blended composites. These materials may be chosen based on their absorbency, softness, durability, and electrostatic properties. Without loss of generality, in some embodiments, microfiber can be used as a material for the sleeve 108 due to its superior ability to attract and hold fine dust and particles through electrostatic charge, while also being gentle on delicate surfaces. Alternatively, a cotton-based pad may be used where natural absorbency and ease of washing are desired. In high-performance applications, synthetic or composite fabrics with hydrophilic or hydrophobic surface treatments may be employed to enhance specific cleaning characteristics, such as water retention, rapid drying, or resistance to bacterial growth.

This design of the sleeve holder 104 advantageously omits the need for traditional mechanical components such as hinges, sliding parts, or separate actuators, thereby reducing complexity and manufacturing costs. The simplicity of the design enhances reliability by minimizing the number of potential failure points. Furthermore, this mechanism can be adapted for other applications requiring variable size or adjustable holders, such as sleeve holders, bag supports, or other devices needing secure yet adjustable fitting.

In this representative example, the cleaning device 102 is implemented as a handheld, portable device designed for manual operation. The cleaning device 102 functions solely through mechanical interaction and user-applied force, without relying on any electrical, electronic, or powered components. This design eliminates the need for batteries, wiring, motors, sensors, or control circuits, thereby simplifying construction, reducing manufacturing costs, and enhancing long-term reliability. The absence of electrical parts also results in a lightweight, highly portable device that is easy to maintain and well-suited for personal, household, or on-the-go cleaning tasks. Moreover, this configuration reduces potential failure points and enables safe operation of the cleaning device 102 in wet or moisture-prone environments without risk of electrical hazards or corrosion.

Various embodiments of the disclosure, as discussed above, may be practiced with steps and/or operations in a different order, and/or with hardware elements in configurations, which are different than those which are disclosed. Therefore, although the disclosure has been described based on these exemplary embodiments, it is noted that certain modifications, variations, and alternative constructions may be apparent and well within the spirit and scope of the disclosure.

Although various exemplary embodiments of the disclosure are described herein in a language specific to structural features and/or methodological acts, the subject matter defined in the appended claims is not necessarily limited to the specific features or acts described above. Rather, the specific features and acts described above are disclosed as exemplary forms of implementing the claims.

What is claimed is:

1. A cleaning device comprising:

a sleeve; and a sleeve holder configured to be inserted within the sleeve, the sleeve holder comprising an extension-retraction element coupled into the sleeve holder, the extension-retraction element configured to transition the sleeve holder between a retracted state and an extended state in response to an applied lateral actuation force, wherein, in the retracted state, the extension-retraction element selectively permits insertion and withdrawal of the sleeve onto and from the sleeve holder, respectively, and wherein, the extension-retraction element returns the sleeve holder to the extended state, upon removal of the applied lateral actuation force to facilitate a snug fit between an outer surface of the sleeve holder and an inner surface of the sleeve during use.

2. The cleaning device as claimed in claim 1, wherein the sleeve holder comprises a first member and a second member, and wherein the first member and the second member are positioned in an overlapping configuration to form a partially enclosed structure.

3. The cleaning device as claimed in claim 2, wherein the extension-retraction element of the sleeve holder is coupled with the first member and extends from a first end section of the first member toward a second end section of the first member along a longitudinal axis of the sleeve holder.

4. The cleaning device as claimed in claim 2, wherein the first member and the second member respectively define a first housing compartment and a second housing compartment, the first housing compartment and the second housing compartment collectively form a housing compartment configured to accommodate at least a portion of the extension-retraction element.

5. The cleaning device as claimed in claim 2, wherein the first member and the second member respectively define a first retention slot and a second retention slot, the first retention slot and the second retention slot collectively form a retention slot configured to guide the movement of the extension-retraction element between the retracted state and the extended state.

6. The cleaning device as claimed in claim 2, wherein the extension-retraction element comprises:

a body portion extending longitudinally from a first end section of the first member and configured to interface with a housing compartment; and a trigger portion operatively coupled to the body portion longitudinally to facilitate the application of the lateral actuation force.

7. The cleaning device as claimed in claim 6, wherein the trigger portion is operatively coupled with a positioning pin, the positioning pin configured to traverse within a retention slot to govern the movement of the extension-retraction element between the retracted state and the extended state.

8. The cleaning device as claimed in claim 7, wherein the extension-retraction element is further configured to:

displace the positioning pin toward a first lateral end of the retention slot in the extended state upon removal of the applied lateral actuation force from the trigger portion; and displace the positioning pin toward a second lateral end of the retention slot in the retracted state upon application of the lateral actuation force to the trigger portion.

9. The cleaning device as claimed in claim 1, wherein the sleeve holder further comprises a handlebar coupled to the sleeve holder via a connecting member, the connecting member being rotatably coupled to the sleeve holder, and pivotally connected to the handlebar.

10. The cleaning device as claimed in claim 9, wherein the connecting member is configured to:

enable a rotational movement of the sleeve holder and a tilt movement of the handlebar while preventing detachment of the connecting member from the sleeve holder and the handlebar, and facilitate a transmission link between the sleeve holder and the handlebar to transmit the lateral actuation force for operating the cleaning device.

11. The cleaning device as claimed in claim 9, wherein the sleeve holder further comprises a first channel and a second channel collectively forming a channel to accommodate an insertable portion of the connecting member, and wherein the first channel is defined by a first member, and the second channel is defined by a second member of the sleeve holder.

12. A cleaning device comprising:

a sleeve; and a sleeve holder configured to be inserted within the sleeve, the sleeve holder comprising an extension-retraction element coupled into the sleeve holder, the extension-retraction element comprising:

a body portion extending longitudinally from a first end section of a first member and configured to interface with a housing compartment, and a trigger portion operatively coupled to the body portion longitudinally to facilitate the application of a lateral actuation force, wherein the extension-retraction element is configured to transition the sleeve holder between a retracted state and an extended state in response to the applied lateral actuation force, wherein, in the retracted state, the extension-retraction element selectively permits insertion and withdrawal of the sleeve onto and from the sleeve holder, respectively, and wherein, the extension-retraction element returns the sleeve holder to the extended state, upon removal of the applied lateral actuation force to facilitate a snug fit between an outer surface of the sleeve holder and an inner surface of the sleeve during use.

13. The cleaning device as claimed in claim 12, wherein the sleeve holder comprises the first member and a second member, and wherein the first member and the second member are positioned in an overlapping configuration to form a partially enclosed structure.

14. The cleaning device as claimed in claim 13, wherein the extension-retraction element of the sleeve holder is coupled with the first member and extends from the first end section of the first member toward a second end section of the first member along a longitudinal axis of the sleeve holder.

15. The cleaning device as claimed in claim 13, wherein the first member and the second member respectively define a first housing compartment and a second housing compartment, the first housing compartment and the second housing compartment collectively form a housing compartment configured to accommodate at least a portion of the extension-retraction element.

16. The cleaning device as claimed in claim 13, wherein the first member and the second member respectively define a first retention slot and a second retention slot, the first retention slot and the second retention slot collectively form a retention slot configured to guide the movement of the extension-retraction element between the retracted state and the extended state.

17. The cleaning device as claimed in claim 12, wherein the trigger portion is operatively coupled with a positioning pin, the positioning pin configured to traverse within a retention slot to govern the movement of the extension-retraction element between the retracted state and the extended state.

18. The cleaning device as claimed in claim 17, wherein the extension-retraction element is further configured to:

displace the positioning pin toward a first lateral end of the retention slot in the extended state upon removal of the applied lateral actuation force from the trigger portion; and displace the positioning pin toward a second lateral end of the retention slot in the retracted state upon application of the lateral actuation force to the trigger portion.

19. The cleaning device as claimed in claim 12, wherein the sleeve holder further comprises a handlebar coupled to the sleeve holder via a connecting member, the connecting member being rotatably coupled to the sleeve holder, and pivotally connected to the handlebar, wherein the connecting member is configured to:

enable a rotational movement of the sleeve holder and a tilt movement of the handlebar while preventing detachment of the connecting member from the sleeve holder and the handlebar, and facilitate a transmission link between the sleeve holder and the handlebar to transmit the lateral actuation force for operating the cleaning device.

20. The cleaning device as claimed in claim 19, wherein the sleeve holder further comprises a first channel and a second channel collectively forming a channel to accommodate an insertable portion of the connecting member, and wherein the first channel is defined by the first member, and the second channel is defined by a second member of the sleeve holder.

* * * * *